US006655759B2

(12) United States Patent
Sacca

(10) Patent No.: US 6,655,759 B2
(45) Date of Patent: Dec. 2, 2003

(54) CONTAINER ASSEMBLY FOR USE WITH A RAPID TRANSFER PORT

(76) Inventor: Giuseppe Sacca, 24241 Tama La., Laguna Niguel, CA (US) 92677

( * ) Notice: Subject to any disclaimer, the term of this patent is extended or adjusted under 35 U.S.C. 154(b) by 6 days.

(21) Appl. No.: 10/078,125

(22) Filed: Feb. 19, 2002

(65) Prior Publication Data

US 2003/0155846 A1 Aug. 21, 2003

(51) Int. Cl.[7] ..... A61G 11/00; B65B 3/00

(52) U.S. Cl. ..... 312/1; 312/4; 141/384; 141/98

(58) Field of Search ..... 312/1, 4, 296; 141/98, 346, 384; 414/217; 220/256, 349, 501, 502

(56) References Cited

U.S. PATENT DOCUMENTS

| | | | | | |
|---|---|---|---|---|---|
| 3,086,565 | A | * | 4/1963 | Mosher | 141/347 |
| 3,289,698 | A | | 12/1966 | Cazalis et al. | 137/614.01 |
| 3,682,208 | A | * | 8/1972 | Fedi et al. | 141/384 |
| 4,162,196 | A | * | 7/1979 | Folsom et al. | 435/304.1 |
| 4,201,310 | A | * | 5/1980 | Glachet | 220/256.1 |
| 4,494,586 | A | | 1/1985 | Picard | 141/384 |
| 4,676,712 | A | * | 6/1987 | Hayward et al. | 414/411 |
| 4,724,874 | A | * | 2/1988 | Parikh et al. | 141/98 |
| 4,995,430 | A | * | 2/1991 | Bonora et al. | 141/98 |
| 5,139,318 | A | * | 8/1992 | Broxup | 312/1 |
| 5,139,459 | A | * | 8/1992 | Takahashi et al. | 454/187 |
| 5,226,781 | A | * | 7/1993 | Glachet et al. | 414/217 |
| 5,263,521 | A | | 11/1993 | Brossard et al. | 141/384 |
| 5,421,626 | A | * | 6/1995 | Glachet | 292/256.5 |
| 5,425,400 | A | * | 6/1995 | Szatmary | 141/98 |
| 5,460,439 | A | | 10/1995 | Jennrich et al. | 312/1 |
| 5,664,951 | A | * | 9/1997 | Clary et al. | 439/92 |
| 5,732,843 | A | | 3/1998 | Glachet et al. | 220/315 |
| 5,870,886 | A | * | 2/1999 | Norton | 53/492 |
| 6,307,206 | B1 | * | 10/2001 | Riviere et al. | 250/453.11 |
| 6,308,749 | B1 | * | 10/2001 | Brossard et al. | 141/91 |
| 6,352,403 | B1 | * | 3/2002 | Fishkin et al. | 414/805 |

FOREIGN PATENT DOCUMENTS

| | | | | |
|---|---|---|---|---|
| EP | 0 450 700 A1 | | 12/1991 | B01L/1/00 |
| GB | 2038920 A | * | 7/1980 | |
| GB | 2102719 A | * | 2/1983 | |
| GB | 2237816 A | * | 5/1991 | |

* cited by examiner

*Primary Examiner*—Leslie A. Braun
*Assistant Examiner*—Naschica S. Morrison
(74) *Attorney, Agent, or Firm*—Lawrence N. Ginsberg

(57) ABSTRACT

The present invention is a container assembly for use with a rapid transfer port. The rapid transfer port (RTP) is of the type having an RTP door, an RTP circular seal around the door, and spaced RTP indentations. The RTP requires rotation of the device being attached thereto. The container assembly includes a circular ring member having an interface end and a bearing system end. The interface end includes a first set of ring member protrusions for engagement with RTP indentations of an RTP and a container assembly circular seal for providing sealing engagement of the ring member and the RTP. A circular enclosure door is concentrically positioned within the ring member. The enclosure door includes a first set of enclosure door indentations for engaging associated RTP door protrusions and a second set of enclosure door indentations for engaging a second set of ring member protrusions. The container assembly circular seal further provides sealing engagement of the ring member and the enclosure door. A bearing system is engaged with the bearing system end of the ring member. An enclosure having a bearing system engagement portion is engaged with the bearing system wherein the bearing system provides relative rotation of the ring member and the enclosure about a central axis of the ring member. The enclosure further includes an enclosure seal operatively engaged with the ring member for providing a sealing engagement between the enclosure and the ring member. The ring member provides the rotation required for proper attachment of the container assembly to the RTP without any requirement for rotation of the enclosure.

23 Claims, 6 Drawing Sheets

CONTAINER ASSEMBLY FOR USE WITH A RAPID TRANSFER PORT

BACKGROUND OF THE INVENTION

1. Field of the Invention

This invention relates to rapid transfer port (RTP) systems for transferring articles between two environments (such as an isolator barrier system and a transfer container) that are adapted to be brought into close proximity to one another by a docking operation. More particularly, the present invention relates to a container assembly for use with an RTP of the type that requires rotation of the device being attached thereto. The container assembly has an enclosure that, during docking, is not required to be rotated.

2. Description of the Related Art

Certain manufacturing processes require the maintenance of separation between two environments to avoid contamination of the cleaner of the two environments by the dirtier of the two. This is accomplished with the use of environments such as isolation barriers. For example, in the case of certain pharmaceutical products, the manufacturing process is performed within these isolation barriers to prevent contamination of the product being produced by dust particles, bacteria and viruses which are found in the outside ambient air. The same holds true for the assembly of certain medical devices. In the case of radioactive operations or bacteriological procedures, the environment within the isolation barrier is dirty as compared to the outside ambient air. In these cases, the isolation barrier serves the function of keeping the product being handled from escaping into the external environment.

In recent years, in the pharmaceutical industry, because of the expense and operational difficulties of maintaining so-called "clean rooms" into which operators enter to carry out procedures, the use of isolation barriers has become common practice. The isolation barriers, in concept large glove boxes, are integrated onto the machinery used to carry out the necessary manufacturing operations. A variation of these isolation barriers is what is commonly known as a RABS, Restricted Access Barrier System.

Means for transferring components, product, supplies, etc. into and out of these isolation barriers without risk of contamination of the components being transferred by the "dirty" external environment during the docking and components transfer process must be provided. To accomplish this, isolator barrier systems and RABS feature devices generally called Rapid Transfer Ports (RTP). These RTP devices may be of various type, size and configuration. A common type of RTP device is one that is offered by the French company La Calhene, referred to as the DPTE. This device requires rotation of the transfer container during the docking process. This type of RTP device is generally mounted on an outer surface of the isolation barrier and features docking attachments for a pre-sterilized transfer container housing the components to be transferred. Upon the docking process, the operator places the transfer container into alignment with the RTP and rotates the container approximately 60 degrees to complete the docking operation. The docking process firmly attaches the transfer container to the RTP and, simultaneously, the transfer container door to the RTP door. Once docked, the operator reaches inside the isolation barrier via gloves located on the isolation barrier wall and opens the RTP door, with it attached the transfer container door, and gains access to the components located within the transfer container. To prevent contamination of the "clean" environment, the docking process places the "dirty" surfaces of the RTP and of the transfer container in sealed contact with each other thus not permitting "dirty" particles to escape into the "clean" environment.

The rotation necessary to dock the transfer container onto an RTP causes tumbling action of the components which are contained within the transfer container. This tumbling action may be acceptable when transferring soft plastic components such as stoppers or cleaning supplies but it is undesirable, if not prohibitive, when transferring heavy, delicate machine components. In addition, the rotation of the container upon docking does not permit interface of the container to a lifting device such as a hoist or crane. Such lifting operation may be necessary to meet the manufacturing requirements of some products.

SUMMARY

The present invention is a container assembly for use with a rapid transfer port. The rapid transfer port (RTP) is of the type having an RTP door, an RTP circular seal around the door, and spaced RTP indentations. The RTP requires rotation of the device being attached thereto. The container assembly includes a circular ring member having an interface end and a bearing system end. The interface end includes a first set of ring member protrusions for engagement with RTP indentations of an RTP and a container assembly circular seal for providing sealing engagement of the ring member and the RTP. A circular enclosure door is concentrically positioned within the ring member. The enclosure door includes a first set of enclosure door indentations for engaging associated RTP door protrusions and a second set of enclosure door indentations for engaging a second set of ring member protrusions. The container assembly circular seal further provides sealing engagement of the ring member and the enclosure door. A bearing system is engaged with the bearing system end of the ring member. An enclosure having a bearing system engagement portion is engaged with the bearing system wherein the bearing system provides relative rotation of the ring member and the enclosure about a central axis of the ring member. The enclosure further includes an enclosure seal operatively engaged with the ring member for providing a sealing engagement between the enclosure and the ring member. The ring member provides the rotation required for proper attachment of the container assembly to the RTP without any requirement for rotation of the enclosure.

Figure 1:
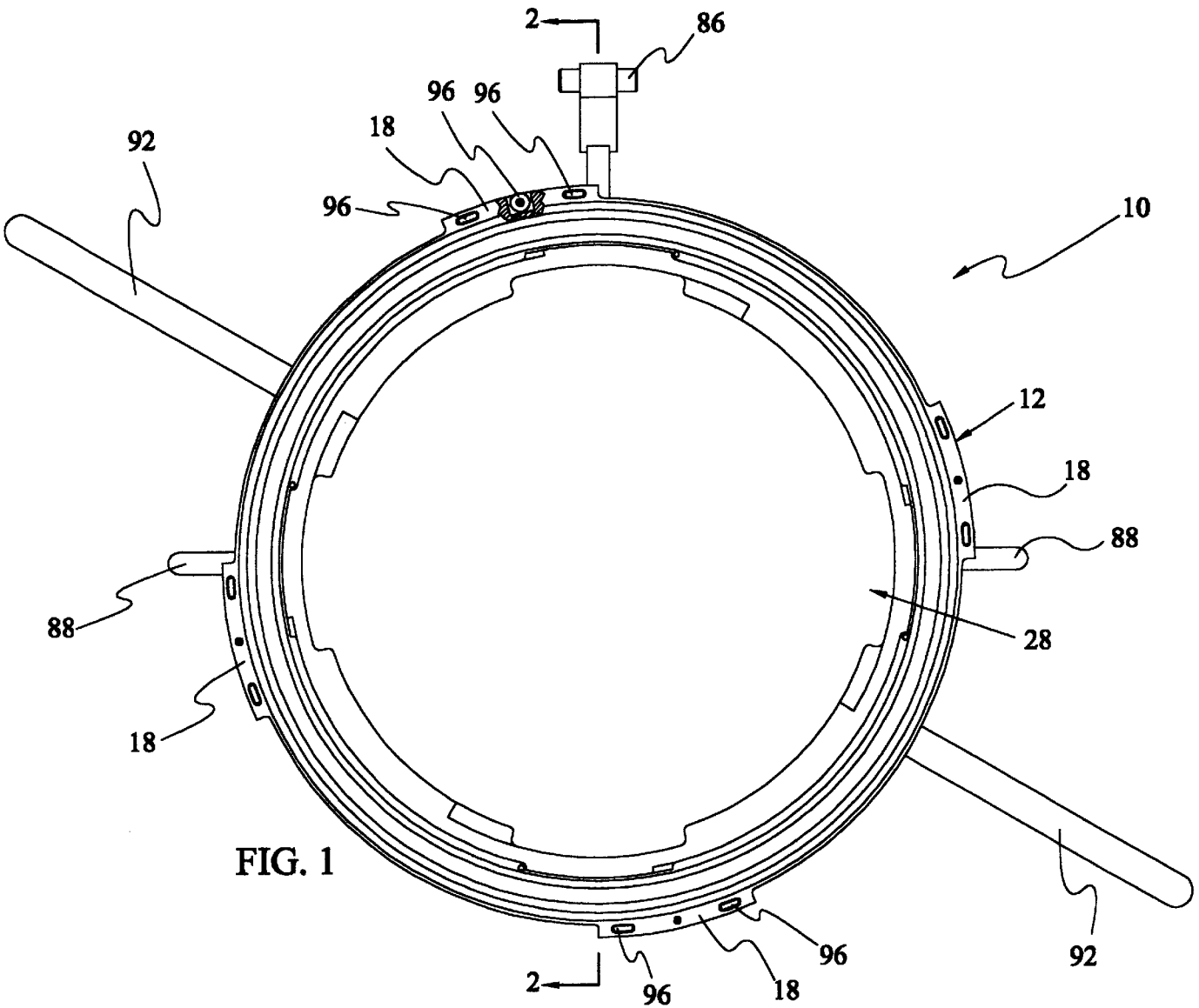
FIG. 1 is an end view of the container assembly of the present invention.

Other objects, advantages, and novel features will become apparent from the following detailed description of the invention when considered in conjunction with the accompanying drawings.

DETAILED DESCRIPTION OF THE INVENTION

Referring to the drawings and the characters of reference marked thereon, FIGS. 1–4 illustrate a preferred embodiment of the present invention, designated generally as 10. The container assembly 10 includes a circular ring member, designated generally as 12. The ring member 12 has an interface end 14 and a bearing system end 16. The interface end 14 includes a first set of ring member protrusions 18 for engagement with RTP indentations 20 of an RTP, designated generally as 22. The RTP 22, shown in phantom in FIG. 2, may be such as that manufactured by the French company, la Calhene, referred to in the industry as "DPTE." The first set of ring member protrusions 18 may be integral parts of ring member 12 or separate parts that are attached to ring member 12 by means of suitable fasteners.

Figure 2:
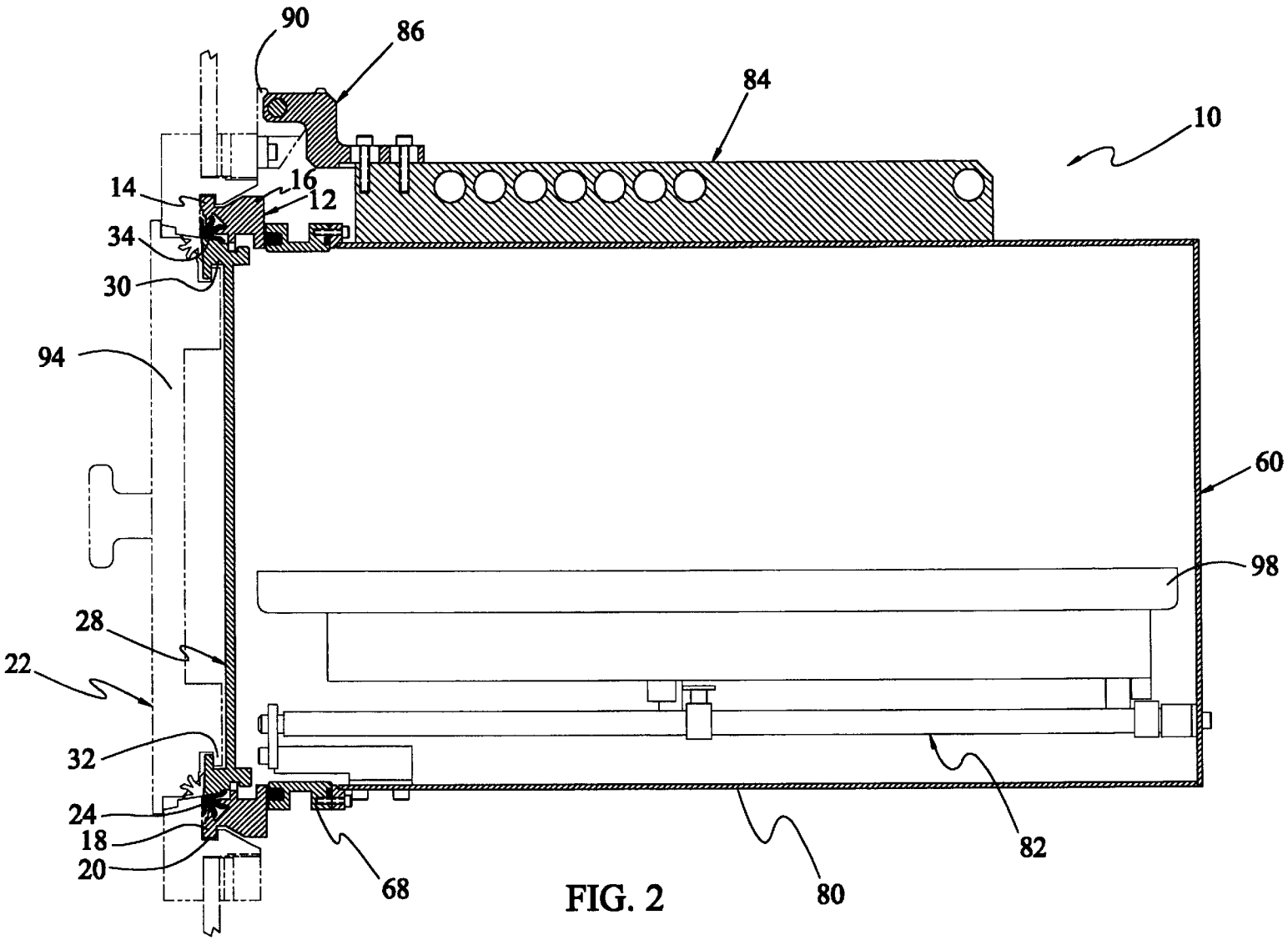
FIG. 2 is a cross-sectional view of the container assembly shown along line 2—2 of FIG. 1 and docked to an RTP system shown in phantom.

The RTP 22 shown in FIG. 2 is very similar to that disclosed in U.S. Pat. No. 5,460,439, issued to Jennrich et al and hereby incorporated by reference. U.S. Pat. No. 3,289,698, issued to Cazalis et al, also discloses an RTP port configuration and is hereby incorporated by reference. The RTP ports in both of these patents require rotation of the container assembly upon docking.

The ring member 12 includes a container assembly circular seal 24 for providing sealing engagement of the ring member 12 and the RTP 22. The circular seal 24 may be, for example, what is known in this industry as a "Beta Seal" that is commercially available. This seal has two contact surfaces on two of its faces and two extensions that engage the seal 24 to the other portions of the ring member 12. It may typically be formed of silicon or Viton™. The seal 24 snaps into a groove 26, as can be seen most clearly in FIGS. 3 and 4.

A circular enclosure door, designated generally as 28, is concentrically positioned within the ring member 12. The enclosure door 28 includes a first set of enclosure door indentations 30 for engaging associated RTP door protrusions 32. The enclosure door 28 includes a tapered outer surface 34 that provides a sealing engagement with an associated surface of the circular seal 24. A second set of enclosure door indentations 36 engage a second set of ring member protrusions 38. The second set of ring member protrusions 38 may be integral parts of the ring member 12 or separate parts that are attached to ring member 12 by means of suitable fasteners. The ring member 12 and enclosure door 28 are typically formed of a metal such as aluminum alloy.

Figure 3:
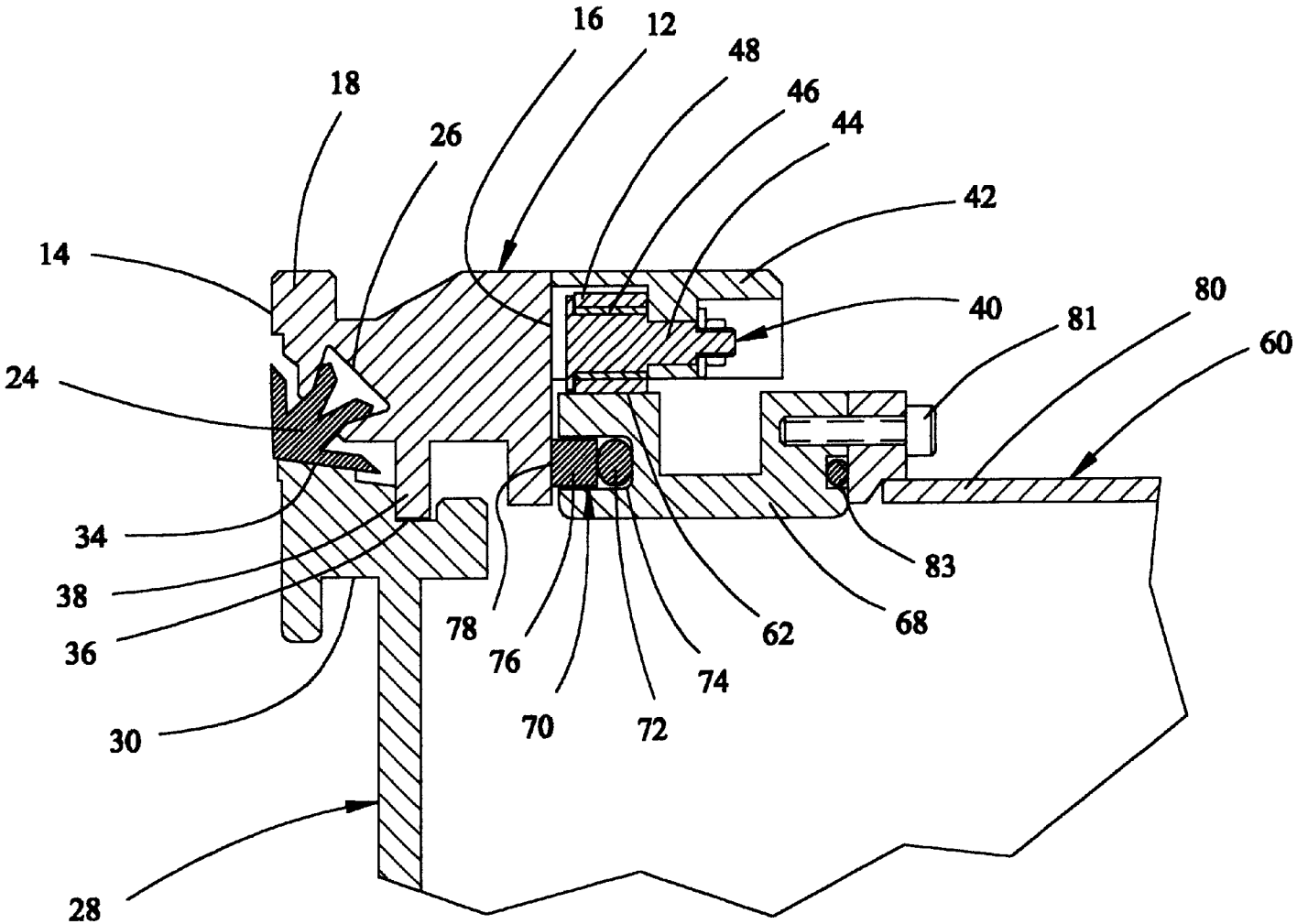
FIG. 3 is a partial cross-sectional view of the container assembly, showing a roller assembly that provides radial positioning.

A bearing system of the container assembly 10 engages with the bearing system end 16 of the ring member 12. Referring now specifically to FIG. 3, the bearing system includes a first set of circumferentially spaced roller assemblies, designated generally as 40. Each roller assembly 40 of this first set is attached to the bearing system end 16 of the ring member 12. This attachment is provided by an associated mount or bracket 42 that is attached to the bearing system end 16 by suitable fasteners such as bolts (not shown). The roller assembly 40 includes a round shaft 44 fastened to mount 42. A plastic bushing 46 is pressed into a metallic roller 48 and rotates freely on shaft 44. This provides radial positioning of the enclosure as described in detail below.

Figure 4:
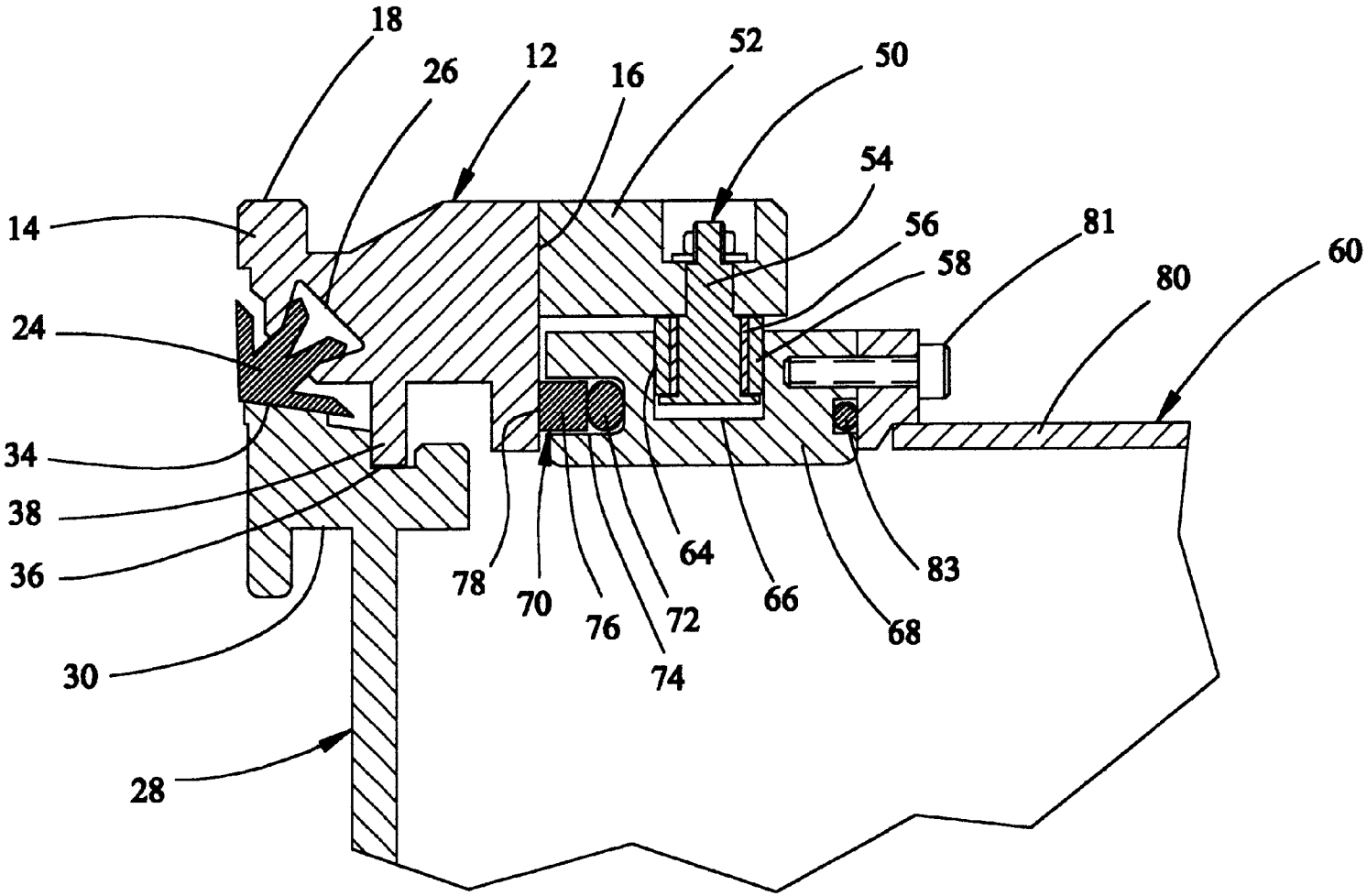
FIG. 4 is a partial cross-sectional view of the container assembly, showing a roller assembly that provides axial positioning.

Referring now specifically to FIG. 4, the bearing system also includes a second set of circumferentially spaced roller assemblies designated generally as 50. As with the first set, each roller assembly 50 of this second set is attached to the bearing system end 16 of the ring member 12. Such attachment is provided by associated mounts or brackets 52, attached to the bearing system end 16 by suitable fasteners. The roller assembly 50 may be designed the same as the roller assembly 40, with the shaft 54, bushing 56 and roller 58.

An enclosure 60 includes a bearing system engagement portion comprising an axially oriented bearing surface 62 (seen in FIG. 3) and a radially oriented bearing surface 64 (seen in FIG. 4). The radially oriented bearing surface 64 is obtained by machining a groove 66 in a forward section 68 of the enclosure 60.

The enclosure 60 includes an enclosure seal, designated generally as 70. The enclosure seal includes an o-ring 72 positioned in a ring member facing groove 74 of the enclosure 60. A sliding element 76 is positioned between the o-ring 72 and a portion 78 of a surface of the bearing system end 16 of the ring member 12. The o-ring 72 provides a compressive force on the sliding element 76 that is transferred onto the ring member 12. The sliding element is preferably formed of Teflon®. The enclosure 60 includes the forward section 68 and a main section 80. The main section 80 may be attached to the forward section 68 by suitable circumferentially spaced fasteners 81 and an o-ring 83. The main section 80 may take different forms depending upon the desired application; however, a specific embodiment will be described below for the purposes of illustration and not limitation. A shuttle assembly, designated as 82 is fastened to a surface of the main section 80 for the purpose of safe transport and handling of internal components. A lifting interface element, designated generally as 84, is permanently attached to the main section 80 for the purpose of safely lifting and transporting the container assembly 10. A support hook device 86 is attached to the lifting interface element 84 for supporting the weight of the container assembly 10 during docking with the RTP 22. The support hook device 86 also functions as an anti-rotation element that prevents rotation of the enclosure 60 relative to RTP 22. Lifting handles 88 are permanently attached along the sides of the main section 80 for safely lifting and carrying the container assembly 10.

The container assembly 10 provides the ability to transfer parts contained within the environment of enclosure 60 to another enclosure such as an isolator barrier system or RABS that has an RTP. The external surfaces of the container assembly 10 and RTP 22 are considered to be contaminated. Therefore, transfer of such parts between the two environments must take place without contacting such outer surfaces. When the container assembly 10 is connected to the RTP 22, all contaminated surfaces are maintained in close contact with each other, including the outer surfaces of the RTP door 94 and the enclosure door 28. This close contact prevents contact of the sterile components with the contaminated surfaces.

During use, the operator, using lifting handles 88, positions the container assembly 10 such that the support hook device 86 engages a mating element 90 of the RTP 22. The operator then assures proper engagement of the container assembly 10 with the RTP 22. The operator then turns ring member 12 using turning handles 92. This turning provides engagement of ring member protrusions 18 with RTP indentations 20 and enclosure door indentations 36 with ring member protrusions 38. During this process, the circular seal 24 remains in contact with RTP 22. However, during this rotation, the enclosure 60 is prevented from rotating by the engagement of support hook 86 and a mating element or cradle 90 of the RTP 22. Although a particular mating element 90 has been shown, this showing is by way of illustration and not limitation. Obviously, other types of mating elements can be used. For example, pin elements or blades or other suitable anti-rotation means can be similarly utilized. Once the required rotation is achieved, the operator actuates a latching device (not shown) on the RTP 22 to open the RTP door 94. The RTP door 94 and the enclosure door 28 open as an integral unit permitting access to any components within the enclosure 60. To facilitate rotation of the ring member 12 in the RTP 22, a set of axially oriented and radially oriented anti-friction rollers 96 are fixed to the ring member protrusions 18.

Once the enclosure door 28 has been opened, the operator may access the shuttle assembly 82, pulling it in or out for retrieving or replacing components on the shuttle tray 98. After the retrieving or the placing of components has been accomplished, the operator can close the enclosure door 28 (along with the RTP door 94) and turn the ring member 12, using handles 92, for disengaging the container assembly 10 from the RTP 22. Then, the container assembly 10 can be disengaged and can be transported using lifting handles 88.

Figure 5:
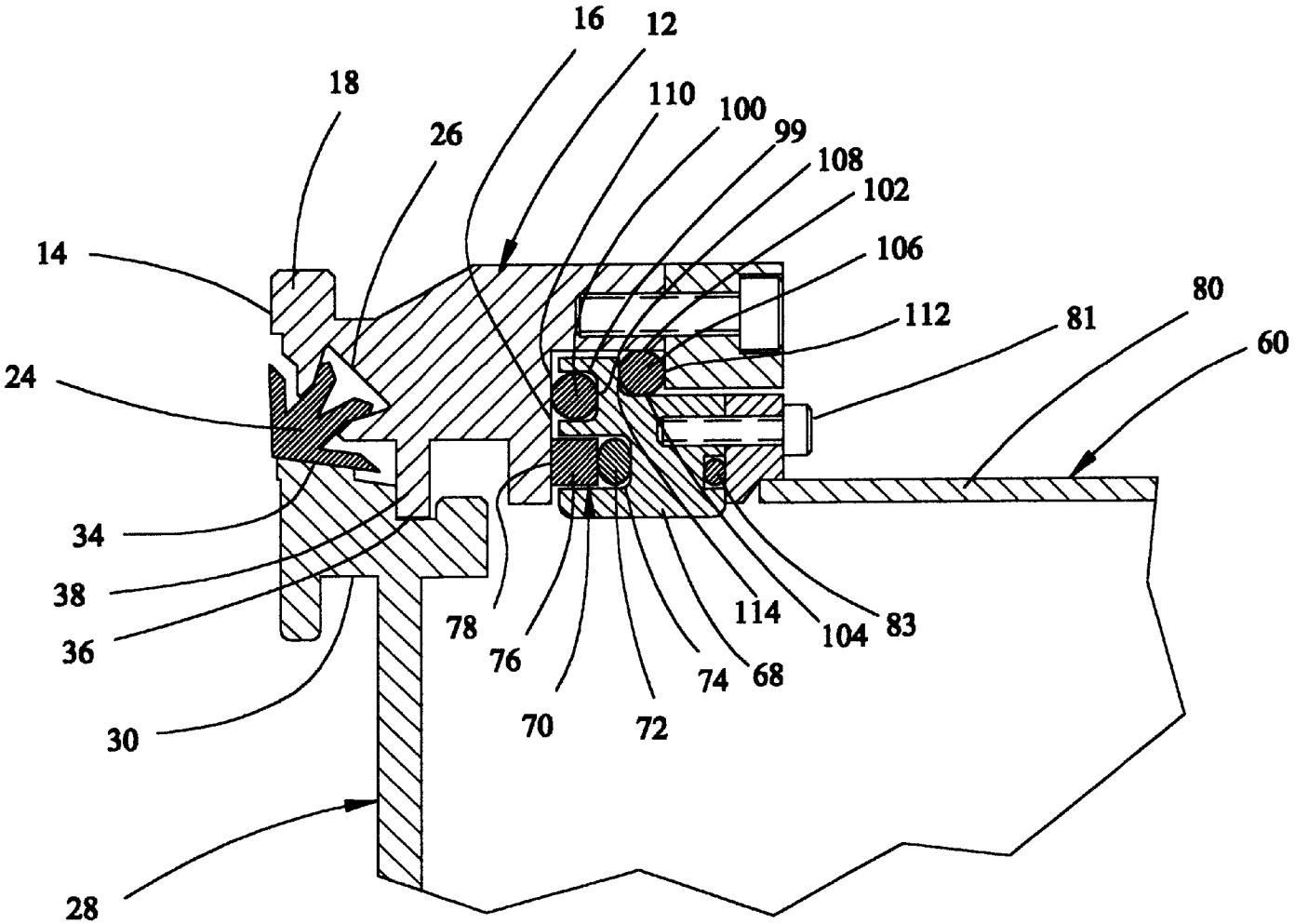
FIG. 5 is a partial cross-sectional view of the container assembly, showing an alternate bearing system consisting of ball bearings.

FIG. 5 shows an alternate embodiment of the bearing system. A first set of circumferentially located ball bearings 100 are positioned in a ring member 12 facing groove 99 of enclosure 60 and are in operative engagement with a radially oriented portion 110 of a surface of the bearing system end 16 of ring member 12 and a radially oriented surface 108 of groove 99. A second set of circumferentially located ball bearings 106 are positioned in a cavity formed by the proximity of ring member 12 and enclosure 60 and are in operative engagement with a radially oriented surface 114 of enclosure 60 and a radially oriented surface 112 of ring member 12 and with an axially oriented surface 104 of enclosure 60 and an axially oriented surface 102 of ring member 12.

Figure 6:
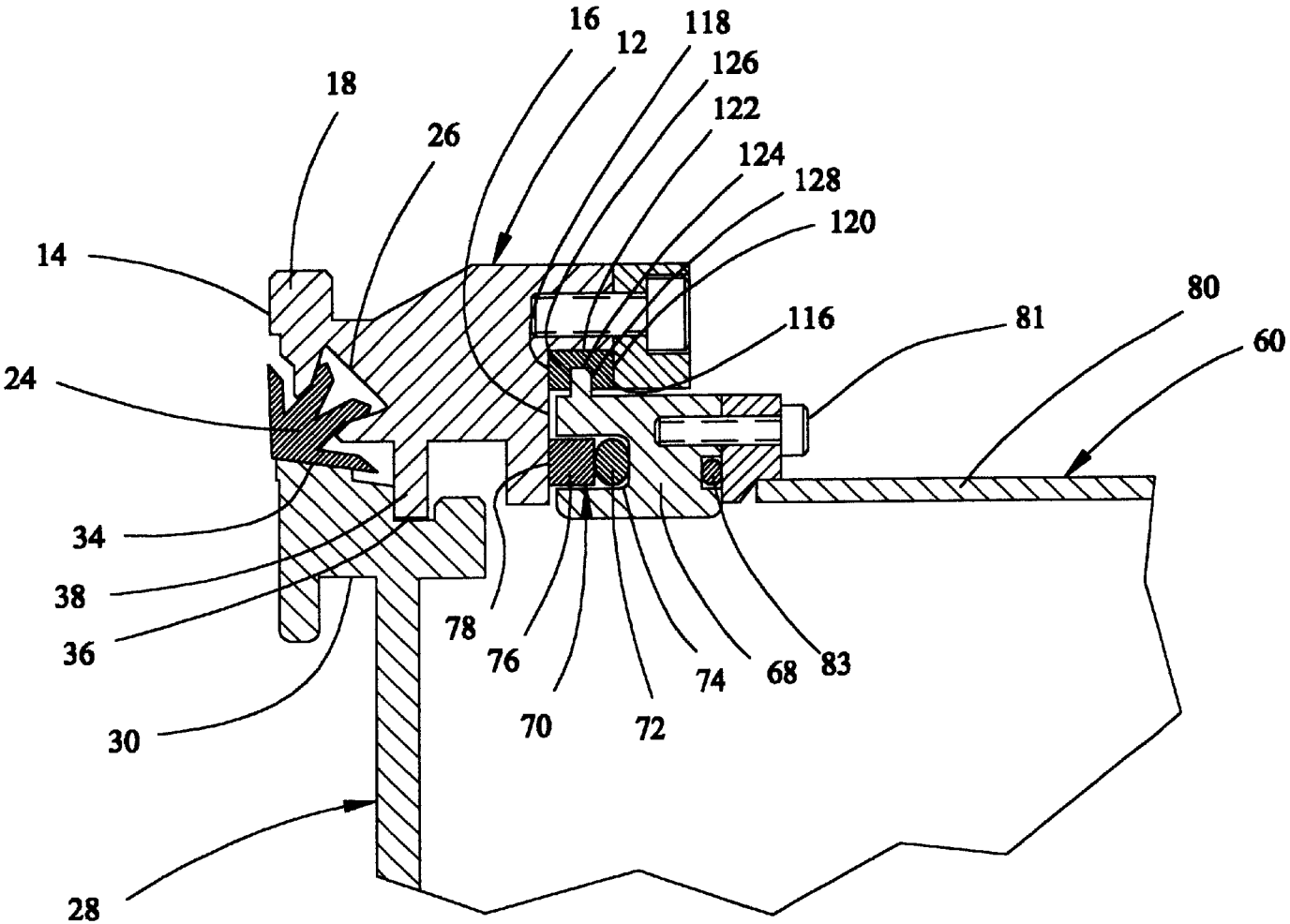
FIG. 6 is a partial cross-sectional view of the container assembly, showing another alternate bearing system consisting of a sliding member.

FIG. 6 shows a third embodiment of the bearing system. A circular sliding member 116 provides both axial and radial positioning of ring member 12 relative to enclosure 60. To maintain axial positioning of ring member 12 relative to enclosure 60, the sliding member 116 is in operative engagement with a radially oriented portion 118 of a surface of the bearing system end 16 of ring member 12 and the corresponding radially oriented surface 126 of enclosure 60, with a radially oriented surface 120 of ring member 12 and a corresponding radially oriented surface 128 of enclosure 60. To maintain radial positioning of ring member 12 relative to enclosure 60, the sliding member 116 is in operative engagement with an axially oriented surface 122 of ring member 12 and an axially oriented surface 124 of enclosure 60.

Although the invention here described is directed mostly for use in the pharmaceutical industry, it is understood that it is equally applicable to the nuclear industry, the medical devices industry, and any other industry requiring transfer of materials through a barrier wall without intermingling of the environments on opposite sides of the barrier wall.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A container assembly for use with a rapid transfer port, the rapid transfer port (RTP) having an RTP door, an RTP circular seal around the door, and spaced RTP indentations, said RTP port requiring rotation of a device being attached thereto, comprising:

a) a circular ring member having an interface end and a bearing system end, said interface end including a first set of ring member protrusions for engagement with RTP indentations of an RTP and a container assembly circular seal for providing sealing engagement of said ring member and the RTP;

b) a circular enclosure door concentrically positioned within said ring member, said enclosure door including a first set of enclosure door indentations for engaging associated RTP door protrusions and a second set of enclosure door indentations for engaging a second set of ring member protrusions, said container assembly circular seal for further providing sealing engagement of said ring member and said enclosure door;

c) a bearing system engaged with said bearing system end of said ring member; and, d) an enclosure having a bearing system engagement portion engaged with said bearing system wherein said bearing system provides relative rotation of said ring member and said enclosure about a central axis of said ring member, said enclosure further including an enclosure seal operatively engaged with said ring member for providing a sealing engagement between said enclosure and said ring member, wherein said enclosure seal, comprises:

an O-ring positioned in a ring member facing groove of said enclosure; and, a sliding element positioned between said O-ring and a portion of a surface of the bearing system end of said ring member, wherein said O-ring provides a compressive force on said sliding element, which is transferred onto said ring member, and, wherein said ring member provides the rotation required for proper attachment of the container assembly to the RTP without any requirement for rotation of said enclosure.

2. The container assembly of claim 1, wherein said sliding element is formed of TEFLON®.

3. The container assembly of claim 1, wherein said bearing system, comprises:

a first set of circumferentially spaced roller assemblies, each being attached to said bearing system end of said ring member and each being in operative engagement with an axially oriented bearing surface of said enclosure for providing radial positioning of said enclosure relative to said ring member upon relative rotation between said enclosure and said ring member; and, a second set of circumferentially spaced roller assemblies, each being attached to said bearing system end of said ring member and each being in operative engagement with a radially oriented bearing surface of said enclosure for providing axial positioning of said enclosure relative to said ring member upon relative rotation between said enclosure and said ring member.

4. The container assembly of claim 1, wherein said bearing system, comprises:

a first set of circumferentially located ball bearings in operative engagement with a radially oriented bearing surface of said ring member and corresponding radially oriented bearing surface of said enclosure for providing axial positioning of said enclosure relative to said ring member upon relative rotation between said enclosure and said ring member; and, a second set of circumferentially located ball bearings in operative engagement with a radially and axially oriented surfaces of said ring member and corresponding radially and axially oriented bearing surfaces of said enclosure for providing axial and positioning of said enclosure relative to said ring member upon relative rotation between said enclosure and said ring member.

5. The container assembly of claim 1, wherein said bearing system, comprises:

a circular sliding member in operative engagement with axially and radially oriented bearing surfaces of said ring member and corresponding axially and radially oriented surfaces of said enclosure for providing radial and axial positioning of said enclosure relative to said ring member upon relative rotation between said enclosure and said ring member.

6. The container assembly of claim 5, wherein said sliding member is formed of TEFLON®.

7. The container assembly of claim 1, wherein said enclosure further comprises an anti-rotation element for engaging a mating element of said RTP thereby presenting relative rotation of said enclosure and said RTP.

8. The container assembly of claim 7, wherein said anti-rotation element comprises a support hook device that supports the weight of the container assembly during attachment of the container assembly to the RTP.

9. The container assembly of claim 1, wherein said enclosure further comprises means for interface to a hoist or lifting system.

10. The container assembly of claim 1, wherein said container assembly circular seal comprises a Beta Seal.

11. The container assembly of claim 1, wherein said ring member further comprises a set of radially oriented rollers and a set of axially oriented rollers fixed to said first set of ring member protrusions for engagement of said first set of ring member protrusions with said RTP indentations.

12. A rapid transfer port (RTP) system, comprising:

an RTP comprising an RTP door, an RTP circular seal positioned around the door and spaced indentations, said RTP requiring rotation of a device being attached thereto; and, a container assembly for use with said RTP, said container comprising:

a) a circular ring member having an interface end and a bearing system end, said interface end including a first set of ring member protrusions for engagement with RTP indentations of an RTP and a container assembly circular seal for providing sealing engagement of said ring member and the RTP;

b) a circular enclosure door concentrically positioned within said ring member, said enclosure door including a first set of enclosure door indentations for engaging associated RTP door protrusions and a second set of enclosure door indentations for engaging a second set of ring member protrusions, said container assembly circular seal for further providing sealing engagement of said ring member and said enclosure door;

c) a bearing system engaged with said bearing system end of said ring member; and, d) an enclosure having a bearing system engagement portion engaged with said bearing system wherein said bearing system provides relative rotation of said ring member and said enclosure about a central axis of said ring member, said enclosure further including an enclosure seal operatively engaged with said ring member for providing a sealing engagement between said enclosure and said ring member, wherein said enclosure seal, comprises:

an o-ring positioned in a ring member facing groove of said enclosure; and, a sliding element positioned between said o-ring and a portion of a surface of the bearing system end of said ring member, wherein said o-ring provides a compressive force on said sliding element, which is transferred onto said ring member, and wherein said ring member provides the rotation required for proper attachment of the container assembly to the RTP without any requirement for rotation of said enclosure.

13. A container assembly for use with a rapid transfer port, the rapid transfer port (RTP) having an RTP door, an RTP circular seal around the door, and spaced RTP indentations, said RTP requiring rotation of a device being attached thereto, comprising:

a) a circular ring member having an interface end and a bearing system end, said interface end including a first set of ring member protrusions for engagement with RTP indentations of an RTP and a container assembly circular seal for providing sealing engagement of said ring member and the RTP;

b) a circular enclosure door concentrically positioned within said ring member, said enclosure door including a first set of enclosure door indentations for engaging associated RTP door protrusions and a second set of enclosure door indentations for engaging a second set of ring member protrusions, said container assembly circular seal for further providing sealing engagement of said ring member and said enclosure door;

c) a bearing system engaged with said bearing system end of said ring member, said bearing system having a rolling element; and, d) an enclosure having a bearing system engagement portion engaged with said bearing system wherein said bearing system provides relative rotation of said ring member and said enclosure about a central axis of said ring member, said enclosure further including an enclosure seal operatively engaged with said ring member for providing a sealing engagement between said enclosure and said ring member, wherein said ring member provides the rotation required for proper attachment of the container assembly to the RTP without any requirement for rotation of said enclosure.

14. The container assembly of claim 13, wherein said enclosure seal, comprises;

an o-ring positioned in a ring member facing groove of said enclosure; and, a sliding element positioned between said o-ring and a portion of a surface of the bearing system end of said ring member, wherein said o-ring provides a compressive force on said sliding element, which is transferred onto said ring member.

15. The container assembly of claim 14, wherein said sliding element is formed of TEFLON®.

16. The container assembly of claim 13, wherein said bearing system, comprises:

a first set of circumferentially spaced roller assemblies, each being attached to said bearing system end of said ring member and each being in operative engagement with an axially oriented bearing surface of said enclosure for providing radial positioning of said enclosure relative to said ring member upon relative rotation between said enclosure and said ring member; and, a second set of circumferentially spaced roller assemblies, each being attached to said bearing system end of said ring member and each being in operative engagement with a radially oriented bearing surface of said enclosure for providing axial positioning of said enclosure relative to said ring member upon relative rotation between said enclosure and said ring member.

17. The container assembly of claim 13, wherein said bearing system, comprises:

a first set of circumferentially located ball bearings in operative engagement with a radially oriented bearing surface of said ring member and corresponding radially oriented bearing surface of said enclosure for providing axial positioning of said enclosure relative to said ring member upon relative rotation between said enclosure and said ring member; and, a second set of circumferentially located ball bearings in operative engagement with a radially and axially oriented surfaces of said ring member and corresponding radially and axially oriented bearing surfaces of said enclosure for providing axial and positioning of said enclosure relative to said ring member upon relative rotation between said enclosure and said ring member.

18. The container assembly of claim 13, wherein said enclosure further comprises an anti-rotation element for engaging a mating element of said RTP thereby presenting relative rotation of said enclosure and said RTP.

19. The container assembly of claim 18, wherein said anti-rotation element comprises a support hook device that supports the weight of the container assembly during attachment of the container assembly to the RTP.

20. The container assembly of claim 13, wherein said enclosure further comprises means for interface to a hoist or lifting system.

21. The container assembly of claim 13, wherein said container assembly circular seal comprises a Beta Seal.

22. The container assembly of claim 13, wherein said ring member further comprises a set of radially oriented rollers and a set of axially oriented rollers fixed to said first set of ring member protrusions for engagement of said first set of ring member protrusions with said RTP indentations.

23. A rapid transfer port (RTP) system, comprising:

an RTP comprising an RTP door, an RTP circular seal positioned around the door and spaced indentations, said RTP requiring rotation of a device being attached thereto; and, a container assembly for use with said RTP, said container comprising:

a) a circular ring member having an interface end and a bearing system end, said interface end including a first set of ring member protrusions for engagement with RTP indentations of an RTP and a container assembly circular seal for providing sealing engagement of said ring member and the RTP;

b) a circular enclosure door concentrically positioned within said ring member, said enclosure door including a first set of enclosure door indentations for engaging associated RTP door protrusions and a second set of enclosure door indentations for engaging a second set of ring member protrusions, said container assembly circular seal for further providing sealing engagement of said ring member and said enclosure door;

c) a bearing system engaged with said bearing system end of said ring member, said bearing system having a rolling element; and, d) an enclosure having a bearing system engagement portion engaged with said bearing system wherein said bearing system provides relative rotation of said ring member and said enclosure about a central axis of said ring member, said enclosure further including an enclosure seal operatively engaged with said ring member for providing a sealing engagement between said enclosure and said ring member, wherein said ring member provides the rotation required for proper attachment of the container assembly to the RTP without any requirement for rotation of said enclosure.

* * * * *

UNITED STATES PATENT AND TRADEMARK OFFICE

CERTIFICATE OF CORRECTION

PATENT NO. : 6,655,759 B2
DATED : December 2, 2003
INVENTOR(S) : Giuseppe Sacca

It is certified that error appears in the above-identified patent and that said Letters Patent is hereby corrected as shown below:

Column 6,
Line 6, after “RTP” delete “port”.

Column 7,
Line 5, before “radially” delete “a”.
Line 8, after “and” insert -- radial --.
Line 24, delete “presenting” and substitute therefor -- preventing --.
Line 45, after “container” insert -- assembly --.
Line 50, delete “an” and substitute therefor -- the --.

Column 9,
Line 20, before “radially” delete “a”.
Line 23, after “and” insert -- radial --.

Column 10,
Line 9, after “container” insert -- assembly --.
Line 14, delete “an” and substitute therefor -- the --.

Signed and Sealed this

Ninth Day of March, 2004

JON W. DUDAS
*Acting Director of the United States Patent and Trademark Office*